US012564773B2

(12) United States Patent
Brewer

(10) Patent No.: US 12,564,773 B2
(45) Date of Patent: Mar. 3, 2026

(54) DOOR OR WALL MOUNT PRO TRAINING BOXING DEVICE

(71) Applicant: Andrew D. Brewer, Milwaukee, WI (US)

(72) Inventor: Andrew D. Brewer, Milwaukee, WI (US)

(73) Assignee: Precision Pro Trainer, LLC, Whitefish Bay, WI (US)

( * ) Notice: Subject to any disclaimer, the term of this patent is extended or adjusted under 35 U.S.C. 154(b) by 108 days.

(21) Appl. No.: 18/412,657

(22) Filed: Jan. 15, 2024

(65) Prior Publication Data

US 2025/0135312 A1 May 1, 2025

Related U.S. Application Data

(60) Provisional application No. 63/440,980, filed on Jan. 25, 2023.

(51) Int. Cl.
*A63B 69/22* (2006.01)
*A63B 69/28* (2006.01)

(52) U.S. Cl.
CPC ..... *A63B 69/222* (2022.08); *A63B 69/28* (2022.08); *A63B 2214/00* (2020.08); *A63B 2225/09* (2013.01); *A63B 2244/102* (2013.01)

(58) Field of Classification Search
CPC ... A63B 69/222; A63B 69/28; A63B 2214/00; A63B 2225/09; A63B 2244/102; A63B 2225/093; A63B 69/22; A63B 2244/10
See application file for complete search history.

(56) References Cited

U.S. PATENT DOCUMENTS

| | | | | |
|---|---|---|---|---|
| 923,928 | A * | 6/1909 | Armitage | A63B 69/222 482/87 |
| 4,050,693 | A * | 9/1977 | Lichterman | A63B 69/222 482/87 |
| 4,084,811 | A | 4/1978 | Kyo | |
| 4,103,889 | A | 8/1978 | Lobur | |
| 4,527,796 | A | 7/1985 | Critelli | |
| 4,533,138 | A | 8/1985 | Rodriguez, Jr. et al. | |

(Continued)

FOREIGN PATENT DOCUMENTS

| | | | |
|---|---|---|---|
| CN | 112742011 | A | 5/2021 |
| CN | 112774156 | A | 5/2021 |

(Continued)

*Primary Examiner* — Andrew M Kobylarz
(74) *Attorney, Agent, or Firm* — Wong Meyer Smith & McConnell

(57) ABSTRACT

A door or wall mounted training boxing apparatus allows a user to practice a variety of different martial arts techniques without having to modify the apparatus. A spring and one or more struts within the apparatus allows a user to practice straight punches, uppercuts, hooks, use as a speedbag, kicks, and elbows. Adding to the versatility of the apparatus, the apparatus may be temporarily installed in a doorway, for example as a piece of home workout equipment, or more permanently installed against a wall or other surface. Additionally, the apparatus includes an air valve that allows for resistance adjustment of the punching ball. Closing the air valve increases the air pressure within the apparatus, increasing the resistance. Opening the air valve decreases the air pressure, decreasing the resistance.

21 Claims, 10 Drawing Sheets

(56) References Cited

U.S. PATENT DOCUMENTS

| | | | | |
|---|---|---|---|---|
| 6,743,157 | B2 | 6/2004 | Hackaday | |
| 8,029,422 | B2 | 10/2011 | Strong et al. | |
| 8,348,815 | B2 | 1/2013 | Signorino | |
| 9,067,115 | B2 | 6/2015 | Fu et al. | |
| 9,227,127 | B2 | 1/2016 | Vince et al. | |
| 9,358,441 | B2 * | 6/2016 | Rea | A63B 69/222 |
| 9,808,694 | B2 | 11/2017 | Stevens | |
| 2011/0251024 | A1 | 10/2011 | Hu | |
| 2013/0010954 | A1 | 1/2013 | Falk et al. | |
| 2014/0066267 | A1 * | 3/2014 | Solah | A63B 69/0053 482/83 |
| 2014/0080682 | A1 * | 3/2014 | Moss | A63B 69/222 482/87 |
| 2015/0057132 | A1 * | 2/2015 | Pedone | A63B 21/0557 29/428 |
| 2018/0221745 | A1 * | 8/2018 | Lamark | A63B 69/30 |
| 2021/0008427 | A1 | 1/2021 | Kamil et al. | |

FOREIGN PATENT DOCUMENTS

| | | | | |
|---|---|---|---|---|
| CN | 214344315 | U | 10/2021 | |
| CN | 216169803 | U | 4/2022 | |
| FR | 2699086 | A1 * | 6/1994 | A63B 69/222 |

* cited by examiner

DOOR OR WALL MOUNT PRO TRAINING BOXING DEVICE

CROSS REFERENCE TO A RELATED APPLICATION

This application claims the benefit of provisional patent application U.S. App. No. 63/440,980, filed on Jan. 25, 2023 and entitled "Door or Wall Mount Pro Training Boxing Device", the entire contents of which are hereby expressly incorporated by reference into the present application.

BACKGROUND OF THE INVENTION

1. Field of the Invention

The present invention relates to a versatile door or wall mounted boxing device that allows a user to practice multiple martial arts techniques without having to modify the device. Additionally, the apparatus utilizes an air valve to adjust the resistance of the apparatus when training.

2. Discussion of the Related Art

Training in martial arts is a common practice. Many of those who train do so on an amateur level as a form of exercise, while others train on a higher level to compete within the field of martial arts. Regardless of the level of training, there is a wide variety of techniques that may be practiced. For example, for boxing alone, a boxer may practice straight punches, left and right hooks, left and right uppercuts, and using a speed bag. Other martial arts techniques include straight elbows, spinning elbows, front kicks, side kicks, and many others.

The current equipment on the market may allow a person to practice one or two of these techniques, but not all of these techniques with a single piece of equipment. For example, a general punching bag may allow a person to hit the bag in multiple ways but cannot be used as a speed bag. Thus, multiple pieces of equipment are required to practice all these techniques. Furthermore, equipment is generally not designed to be used or installed in a home. For example, a punching bag is heavy and large and generally requires a permanent installation that would take up too much space in a home. Also, equipment that is designed for at-home use typically further limits the techniques a user may practice, such as only allowing straight punches or use as a speed bag. Therefore, a person who wishes to practice a wide variety of techniques must either purchase multiple pieces of equipment or join a martial arts gym, both of which are costly.

Additionally, most of the equipment on the market is provided as a one-size-fits all apparatus with little or no ability to adjust features. For example, a punching bag may place excessive stress on certain users because the bag is too heavy producing excess resistance. Similarly, some equipment requires permanent installation, which may be installed at heights that are ill-suited for certain users. Improperly fitted martial arts equipment may especially be a concern for younger users, older users, or amateur users, causing pressure and strain in their body and joints.

Therefore, there is a need in the market to provide a versatile martial arts apparatus that may be easily installed in a home and is adjustable for varying users.

OBJECTS AND SUMMARY OF THE INVENTION

The disclosed invention addresses the above-identified issues and improves upon the prior art by providing a door or wall mounted pro training boxing device on which a user may practice a variety of different martial arts techniques, such as straight punches, hooks, uppercuts, elbows, kicks, and use as a speed bag. This wide variety of techniques may be practiced without modifying the device. Additionally, the present invention may incorporate an air valve that allows the resistance of the punching ball to be varied.

The present invention includes a punching ball, which may be lightweight so as to avoid causing stress on the user when striking the ball. The punching ball may connect to one end of an extension rod. The other end of the extension rod may connect to one end of a hollow arm, which defines an internal volume that holds a volume of air. The extension rod and the hollow arm may be connected via a special connector such that the connection at least partially seals the air within the internal volume in the hollow arm. This connection may also allow the extension rod to slide within the hollow arm along the length of the hollow arm. An internal spring may be installed in the hollow arm and abut the extension rod. The internal spring may be configured such that the extension rod is predisposed to return to an initial position after the extension rod is pushed further into the hollow arm. The opposite end of the hollow arm may connect to a mount spring, which may subsequently connect to a mount. Further, an air valve may also be installed on the hollow arm, such that the air valve is in fluid communication with the internal volume of the hollow arm.

This design allows for a user to adjust the resistance of the punching ball when practicing straight punches. When the punching ball is struck with a straight punch, the extension rod will slide from its initial position further into the hollow arm, and then return to the initial position. When the extension rod is pushed into the hollow arm, a volume of air within the hollow arm may be displaced. The air valve may control whether the displaced air is able to escape through an open air valve or is trapped in a sealed internal volume because the air valve is closed. Whether the displaced air may be released may control the air pressure in the hollow arm, which may subsequently control the resistance of the punching ball. Thus, adjusting the air valve may adjust the resistance of the punching ball for straight strikes.

Additionally, an upper arm and a linkage may connect to the lower assembly. The upper arm may extend from the mount. At the end of the upper arm, a linkage may connect the upper arm and the hollow arm. The linkage may allow movement in at least one direction. For example, the linkage may include at least one strut allowing linear movement along the length of the strut. A 90-degree fitting may attach the upper arm and the strut. The upper arm may be configured in such a way to allow rotation of the upper arm and the 90-degree fitting to rotate around the center axis of the upper arm. A threaded connection may attach the upper arm to the mount and allow this rotation.

With the movement of the strut and the rotation of the upper arm, this upper assembly provides additional stability for the punching ball and lower assembly while allowing flexibility for the punching ball to be struck from a variety of angles. If the punching ball is struck with an uppercut, the strut and the mount spring may allow the lower assembly to move upward with the punch. Further, if the punching ball is struck with a hook, the mount spring and the rotating upper assembly may allow movement to the side. This movement to the side may also allow a user to stand to the side of the apparatus and use the punching ball as a speed bag. Thus, the punching ball may be struck from a variety of angles in a variety of ways. The mount spring and strut may then return the punching ball and rest of the lower assembly back to its initial position.

In one embodiment of the present invention, the martial arts apparatus includes a punching ball that is connected to one end of an extension rod. The other end of the extension rod is connected to one end of a hollow arm, which has a length. The extension rod and the hollow arm are connected such that the extension rod is at least partially inserted into the internal volume of the hollow arm and configured such that the extension rod can slide along the length of the hollow arm within the internal volume. The embodiment may also have an air valve that is connected to the hollow arm that is in fluid communication with the internal volume of the hollow arm. The air valve and extension rod may be configured such that the internal volume of the hollow arm is at least partially sealed when the air valve is in the closed position. Further, the other end of the hollow arm may be connected to one end of a mount spring. The other end of the mount spring may then be connected to a mount.

This embodiment may also include a second arm extending from the mount. A linkage may connect the second arm with the hollow arm and be configured to allow the hollow arm to move in at least one direction. The linkage may include at least one strut.

In another embodiment, the martial arts apparatus includes a mount and a projection extending from the mount. The projection includes: a mount spring, a hollow arm defining an internal volume and having a length, an air valve having at least an open and a closed position, an extension rod, and a punching ball. The projection is configured in the following way. The mount spring extends from the mount. The hollow arm extends from the mount spring. The air valve is connected to the hollow arm such that the air valve is in fluid communication with the internal volume. The extension rod extends from the hollow arm such that the extension rod is at least partially inserted into the internal volume. The punching ball is connected to the extension rod. The air valve and the extension rod are configured such that that the extension rod can slide within the internal volume along the length of the hollow arm, and the internal volume is at least partially sealed with the air valve in the closed position.

This embodiment may also include a second projection extending from the mount and a linkage connecting the first and second projections. The linkage may be configured to allow movement of the first projection in at least one direction. The linkage may include at least one strut.

Yet another embodiment of the present invention includes a method of practicing martial arts with a martial arts apparatus. The method includes providing a martial arts apparatus that includes a mount, a mount spring that extends from the mount, and a hollow arm extending from the mount spring. The hollow arm defines an internal volume of air and has a length. An air valve that is in fluid communication with the internal volume of air is connected to the hollow arm. An extension rod extends from the hollow arm such that at least part of the extension rod is inserted into the internal volume and is configured to slide within the internal volume along the length of the hollow arm. A punching ball then extends from the extension rod.

The method further includes striking the punching ball with a force in the same direction as the length of the hollow arm when the air valve is open. This strike will produce the following. The extension rod will be further inserted into the hollow arm moving from an initial position to a second position. A volume of air from the internal volume will be pushed out of the hollow arm through the air valve. Finally, the extension rod is returned to the initial position.

In one other embodiment, a method includes the additional steps of performing the following martial arts techniques without modifying the apparatus: a straight punch, a hook, an uppercut, a speedbag strike, a kick, and an elbow.

In another embodiment, the method may include turning the air valve to the closed position, and subsequently striking the punching ball with the same force as before producing the following steps. The extension rod will be further inserted into the hollow arm moving from the initial position to a third position. The distance from the initial position to the third position is shorter than the distance from the initial position to the second position. The majority of the volume of air within the internal volume is maintained within the internal volume. Finally, the extension rod is returned to the initial position.

Other aspects, features and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements can be several views, and in which.

Figure 1:
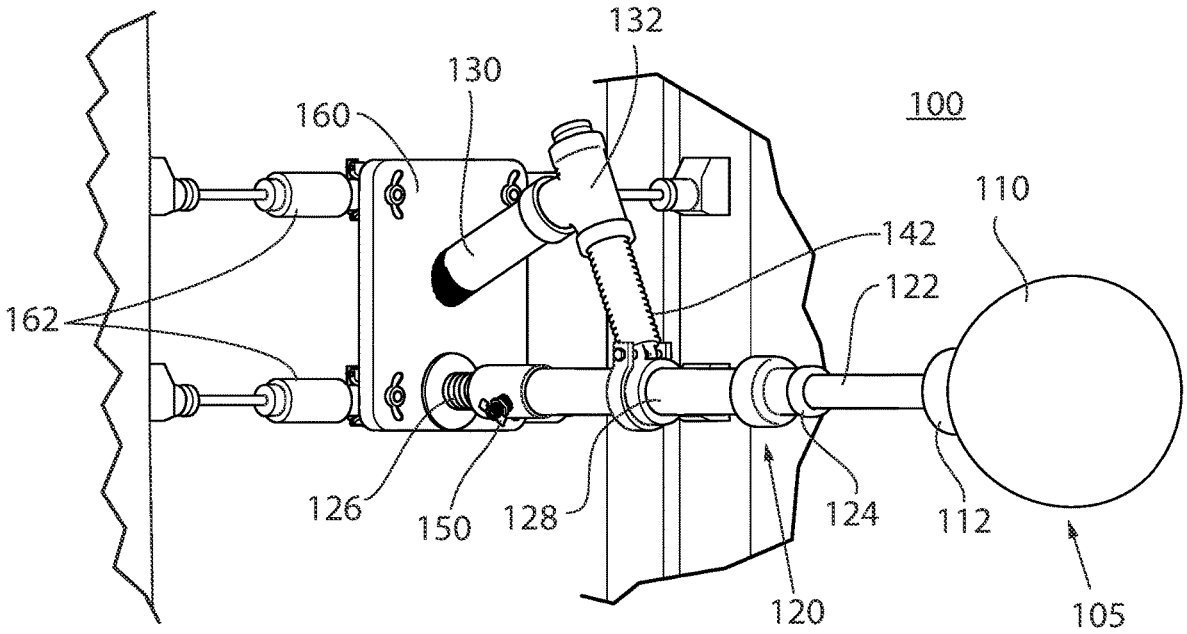
FIG. 1 illustrates an isometric view of an embodiment of a martial arts apparatus in accordance with the present invention, mounted in a doorway.

In describing the preferred embodiment of the invention that is illustrated in the drawings, specific terminology will be resorted to for the sake of clarity. However, it is not intended that the invention be limited to the specific terms so selected, and it is to be understood that each specific term includes all technical equivalents, which operate in a similar manner to accomplish a similar purpose. For example, the words "connected", "attached", or terms similar thereto are often used. They are not limited to direct connection but include connection through other elements where such connection is recognized as being equivalent by those skilled in the art.

DETAILED DESCRIPTION

The present invention and the various features and advantageous details thereof are explained more fully with reference to the non-limiting embodiments described in detail in the following description.

FIG. 1 depicts an embodiment of a martial arts apparatus 100 in accordance with the present invention. The apparatus 100 includes a lower projection 120 extending from a mount 160 with a punching ball assembly 105 attached to the end of the lower projection 120. The apparatus 100 may also include an upper arm 130, which extends from the mount 160 and is attached to the lower projection 120 via a moveable linkage, such as a strut 140. The apparatus 100 of the present invention allows a user to strike the punching ball 110 from a variety of angles with a variety of martial arts techniques without needing additional equipment or modification. Further, the martial arts apparatus 100 may be mounted in a doorway or wall mounted. The apparatus 100 may also utilize an air valve 150 to provide an adjustable resistance for straight punches.

The apparatus 100 may include a mount 160 at one end of the apparatus 100. The mount 160 may be a be a panel capable of being attached to another object for stabilization. The mount 160 may include bolt holes or other features to use fasteners with the mount 160. For example, the mount 160 may include bolt holes in each corner. In one embodiment, the mount 160 may be made of high-density polyethylene plastic. In other embodiments, the mount 160 may be comprised of other materials, such as other plastics, metal, or some other material. The mount 160 may be rectangular or any other shape that is suitable for attaching the mount 160 to another object.

A mount spring 126 may extend from the mount 160. The mount spring 126 may be of a high strength quality. The mount spring 126 may have two ends, the near or proximate end connected to the mount 160 and may directly thread into the mount 160. The distal end of the mount spring 126 may allow movement in all directions with the disposition to return to its initial, natural position. In one embodiment, the mount spring 126 may have a diameter of less than two (2) inches and a length of less than five (5) inches. Further, in another embodiment, the mount spring 126 may have a diameter of 1½ inches and a length of four (4) inches.

Figure 2:
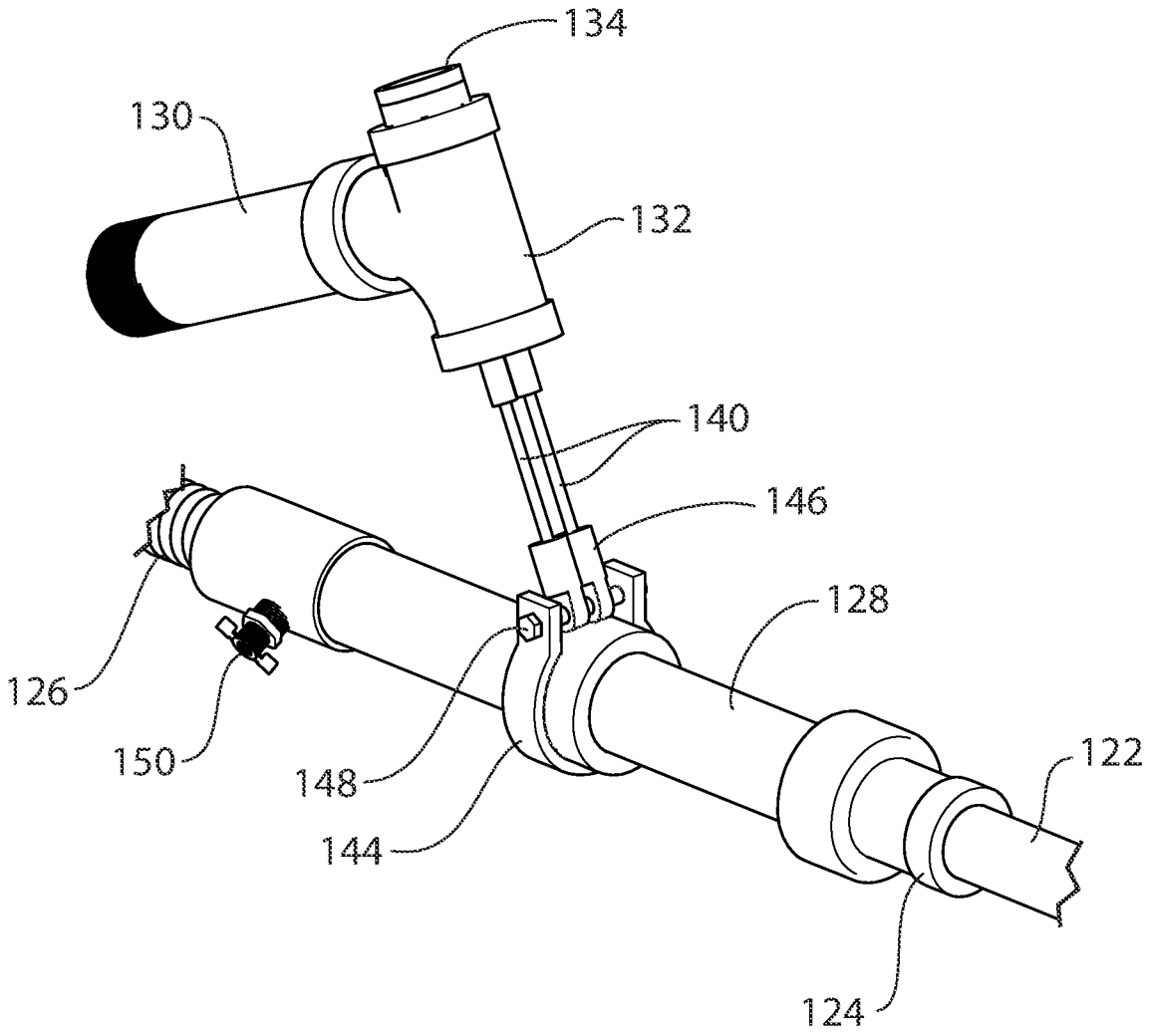
FIG. 2 illustrates an isometric view of a subassembly of the apparatus from FIG. 1 depicting the lower projection connected to the upper arm without a strut cover.

As shown in FIG. 2, a hollow arm 128 may connect to the distal end of the mount spring 126. The connection between the hollow arm 128 and the mount spring 126 may be direct or indirect with an additional joint or connection between the components. The hollow arm 128 defines an internal volume within the hollow arm 128 that contains some volume of air. Further, the hollow arm 128 may have two ends, the near or proximate end being connected to the distal end of the mount spring 126. In one embodiment, the hollow arm 128 may be made of PVC. In other embodiments, the hollow arm 128 may be made of another type of plastic, metal, or some other material.

The distal end of the hollow arm 128 may be connected to an extension rod 122. The extension rod 122 may be an elongated bar having two ends, the near or proximate end connected to the distal end of the hollow arm 128. In one embodiment, the extension rod 122 may be comprised of stainless steel. In other embodiments, the extension rod 122 may be comprised of some other metal, a plastic, or some other material.

The extension rod 122 and the hollow arm 128 may be connected in such a way that at least part of the extension rod 122 is inserted into the internal volume of the hollow arm 128. Additionally, the extension rod 122 may be capable of being further inserted and subsequently removed from the internal volume of the hollow arm 128. In other words, the extension rod 122 may be capable of sliding further into and out of the hollow arm 128. This connection may be formed with a special connector 124. In one embodiment, the special connector 124 may be a special reinforced cap. An air-tight seal may be formed at the connection of the extension rod 122 and the hollow arm 128 such that the air within the internal volume of the hollow arm 128 may not escape the internal volume through the connection under normal conditions. In one embodiment, an air-tight seal may be formed by having the extension rod 122 inserted through the special connector 124 with minimal clearance between the extension rod 122 and the special connector 124, as shown in FIG. 3.

Figure 3:
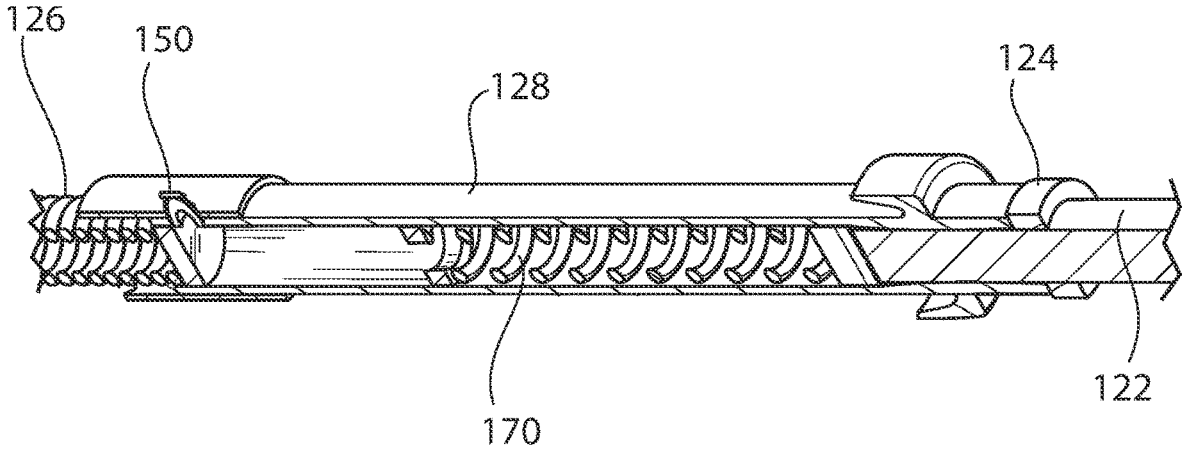
FIG. 3 illustrates a sectional view of a subassembly of the apparatus from FIG. 1 depicting the hollow arm and internal spring.

As also shown in FIG. 3, an internal spring 170 may also be installed within the hollow arm 128. The internal spring 170 may be an elongated spring positioned in line with the length of the hollow arm 128 and may abut the extension rod 122. The internal spring 170 may be configured in such a way as to provide resistance to and dampen the force of the extension rod 122 being further inserted into the internal volume of the hollow arm 128. Further, the internal spring 170 may be configured such that the extension rod 122 is predisposed to return to its initial position after the extension rod 122 is further inserted into the hollow arm 128. Various embodiments may utilize different strength or quality springs for the internal spring 170 to vary the resistance of the punching ball 110. One embodiment utilizes a 25 lb compression spring for the internal spring 170. Another embodiment utilizes a 35 lb spring for increased resistance. In one other embodiment, the internal spring 170 may be a 9-inch spring.

A punching ball assembly 105, which includes a punching ball 110, may be connected to the distal end of the extension rod 122. The punching ball 110 may be a lightweight ball designed to be struck without hurting the striker. In one embodiment, the punching ball 110 is a high-speed punch ball. In another embodiment, the punching ball 110 is a 9-inch high speed punch ball. Another embodiment may include a modified leather speed bag boxing ball as the punching ball 110. In yet another embodiment, the punching ball 110 is 7 inches wide with a 10-inch height. As shown in FIG. 1, the connection between the punching ball 110 and the extension rod 122 may be covered by a foam pad 112 to prevent a user from hitting the connection or the distal end of the extension rod 122. In one embodiment, the foam pad 112 may include a silicone reducer.

Figure 4:
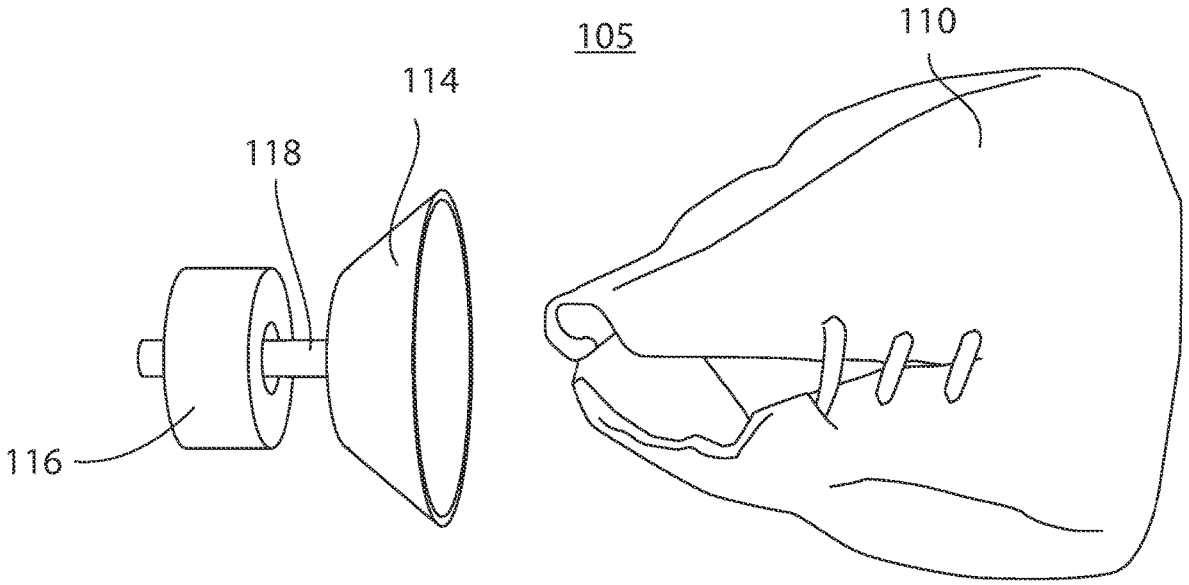
FIG. 4 illustrates an exploded view of a subassembly of the apparatus from FIG. 1 depicting a punching ball assembly.

As shown in FIG. 4, the punching ball assembly 105 may include a rubber sleeve 114, a disk 116, and a ball connecting screw 118. The ball connecting screw 118, which may be threaded, may connect the distal end of the extension rod 122 and the punching ball 110. The rubber sleeve 114 and the disk 116 may be installed around the exposed area of the ball connecting screw 118. The rubber sleeve 114 may increase in diameter to form around a portion of the punching ball 110, which may be generally spherically shaped. The disk 116 may be a few inches thick and may be made of wood, plastic, metal, or some other material. In one embodiment, the punching ball assembly 105 includes the punching ball 110, the foam pad 112, a rubber sleeve 114, a disk 116, and a ball connecting screw 118.

The apparatus 100 of the present invention may also include an air valve 150 that is connected to the hollow arm 128. The air valve 150 may be in fluid communication with the internal volume of hollow arm 128. The air valve 150 may have an open position and a closed position, as well as having the capability to be partially open or closed. The apparatus 100 may be configured such that when the air valve 150 is turned to the closed position, the internal volume of the hollow arm 128 is at least partially sealed. When the air valve 150 is turned to the open position, the volume of air within the internal volume of the hollow arm 128 may flow out of the hollow arm 128 through the air valve 150.

Opening and closing the air valve 150 may vary the resistance provided by the punching ball 110 when striking the punching ball 110 with a straight punch. Striking the punching ball 110 in approximately the same direction as the lengths of the extension rod 122 and hollow arm 128 when a user is in front of the punching ball 110 constitutes a straight punch. When hit by a straight punch, the extension rod 122 is pushed further into the internal volume of the hollow arm 128 and may compress the internal spring 170. When the air valve 150 is in the open position, the air within the internal volume is pushed out of the hollow arm 128 through the air valve 150. There is little pressure within the internal volume as air may easily exit the internal volume, so little resistance via air pressure is provided on the punching ball 110. When the air valve 150 is closed, the air in the internal volume is at least partially sealed within the hollow arm 128 and cannot escape through the air valve 150. Thus, the trapped air causes pressure within the hollow arm 128 as the punching ball 110 is struck, providing resistance against the extension rod 122 and punching ball 110.

The martial arts apparatus 100 of the present invention may also include a second projection or second arm extending from the mount 160. The second projection may be above the lower projection 120 and connect to the lower projection 120. The second projection may include an upper arm 130 that extends from the mount 160. The upper arm 130 may have two ends, the near or proximate end connecting to the mount 160. The near or proximate end of the upper arm 130 may be directly threaded into the mount 160. Further, the upper arm 130 may connect with the mount 160 at an angle. For example, the upper arm 130 may extend from the mount 160 at a 30-degree angle from a horizontal plane. In one embodiment, the upper arm 130 may be a PVC tube. In other embodiments, the upper arm 130 may be comprised of another material or may be a non-hollow bar.

The distal end of the upper arm 130 may be connected to the lower projection 120 via a linkage. The linkage may connect the distal end of the upper arm 130 and the hollow arm 128. Further, the linkage may allow for movement in at least one direction by the hollow arm 128.

The linkage may include at least one strut 140. In one embodiment, the linkage may include two struts 140. Further, other embodiments may include more than two struts 140. A strut 140 may allow for linear movement along the length of the strut 140. A strut 140 may have two ends, a stationary end and a mobile end. A strut 140 may dampen a force exerted on the mobile end toward the stationary end. Further, a strut 140 may allow linear movement along the length of the strut 140, but the strut 140 is predisposed to return the mobile end to the initial position. Thus, one or more struts 140 attached to a hollow arm 128 may allow the hollow arm 128 to move in an upward direction before returning the hollow arm 128 to its initial position.

In one embodiment, the apparatus 100 includes two struts 140, as shown in FIG. 2. The stationary ends are connected to the distal ends of the upper arm 130, and the mobile ends are connected to the hollow arm 128. The struts 140 dampen a force in the upward direction, such as a force caused by an uppercut strike on the punching ball 110. The mobile ends of the struts 140 move linearly toward the stationary ends of the struts 140. After the force dissipates, the struts 140 are predisposed to move the mobile ends of the struts 140 back to their initial position.

In one embodiment, the apparatus 100 includes a gas strut. In other embodiments, a spring strut, a spring, or some other similar moveable joint is used. Other embodiments include one or more gas struts with a length of less than 10 inches, 8 inches, or 6 inches.

As shown in FIG. 2, a strut or struts 140 may be connected to a hollow arm 128 via a tube clamp 144. Both ends of a connecting strut 140 may include a strut end connector 146. The tube clamp 144 and the strut end connector 146 may contain corresponding features allowing the connection of the strut 140 and the hollow arm 128. For example, a tube clamp 144 may include two holes, one at each end, that align with a hole in a strut end connector 146. A fastener, such as a strut screw 148, may then be installed through the aligned holes connecting the strut 140 and the hollow arm 128. As shown in FIG. 1, the strut 140 may then be covered by a strut cover 142, which does not restrict the movement of the strut 140 and may be moveable itself. In one embodiment, the strut cover 142 is a rubber shock cover boot sleeve. In another embodiment, the struts 140 are exposed, as shown in FIG. 2.

As illustrated in FIG. 2, a 90-degree fitting 132 may connect the one end of a strut or struts 140 with an upper arm 130. A 90-degree fitting 132 may be comprised of general T-fitting with an end cap 134. An end of a strut 140 may be installed within the 90-degree fitting 132 having the opposite end of the strut 140 extending toward the hollow arm 128. In one embodiment, the stationary ends of struts 140 are installed within the 90-degree fitting 132. The 90-degree fitting 132 may not be exactly 90 degrees, but rather have an acute or obtuse angle.

The upper assembly may be configured in such a way as to allow rotation of the upper assembly around the center axis of the upper arm 130. The connection of the upper arm 130 to the mount 160 may allow this rotation. The upper arm 130 may be threaded into the mount 160. The threads may be configured to allow the upper arm 130 to spin. This rotation of the upper arm 130 at the mount 160 may allow sideways movement of the hollow arm 128 if a force is exerted perpendicular to the hollow arm 128, such as a hook on the punching ball 110. When the punching ball 110 is struck from the side, the hollow arm 128 is subsequently forced to the side. Because the upper arm 130 may have freedom to spin, the struts 140 and 90-degree fitting 132 turn to the side with the hollow arm 128 as the upper arm 130 spins.

Figure 5:
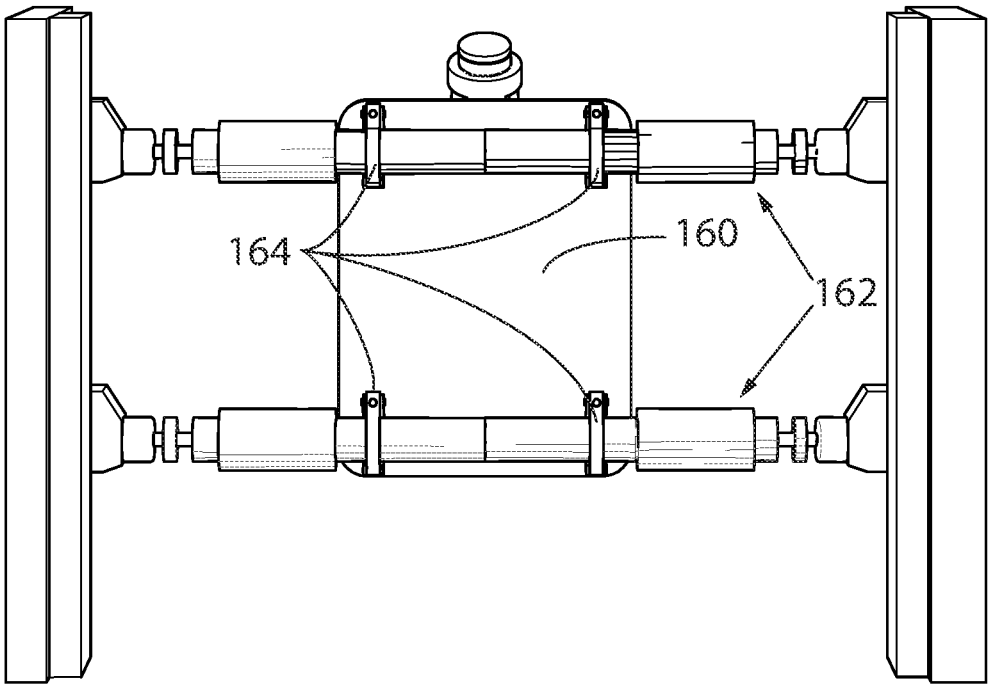
FIG. 5 illustrates a back view of the apparatus from FIG. 1.

The present apparatus 100 may be mounted in a variety of different ways. The mount 160 may attach to one or more mounting bars 162, as shown in FIG. 5. A mounting bar 162 may be an elongated bar that is capable of being attached in an opening, such as a doorway. A mounting bar 162 may be designed to permanently attach to an object or to be temporarily attached with an easy way to detach the mounting bar 162. The mounting bars 162 may be attached to the mount 160 via one or more bar clamps 164, as shown in FIG. 5. A bar clamp 164 may wrap around a mounting bar 162 and attach to a fastener feature, such as a bolt hole, in the mount 160.

As shown in FIGS. 1 and 5, the apparatus 100 may be installed in a doorway. In one embodiment, the apparatus 100 may be installed in a home doorway. The one or more mounting bars 162 may be suited to attach to a doorframe, as is common with many home pull-up bar designs. In one embodiment, the mounting bars 164 are adjustable pull-up bars. The mounting bars 162 may utilize a press fit, pushing both ends of the mounting bars 162 against the doorframe with enough tension to hold the apparatus 100 at a certain height. In other embodiments, the mounting bars 162 may include clamps or some other means to secure the apparatus 100 to a doorway. The mount spring 126 and one or more struts 140 dampen the strikes against the punching ball 110 and subsequent vibrations making the apparatus 100 well-suited to be installed in a doorway. The dampening may mitigate the need for more secure, but more permanent, fasteners.

In this door-way embodiment, the mounting of the apparatus 100 may be adjusted in a number of ways. The mounting bars 162 may be adjustable in length so as to fit to a variety of different door-way sizes. The mounting bars 162 may be shortened or lengthened to customize the mounting of the apparatus 100 to a particular location. Further, the mounting bars 162 may be installed at varying heights along a doorway. The height the apparatus 100 is installed may be adjusted to fit the height or preference of the user. The height may also be adjusted based on the martial arts technique being practiced. For example, a user may wish to have the apparatus 100 set to different heights for use as a speed bag than when practicing kicks. Additionally, the mounting bars 162 may be easily attached and removed from a doorway such that the apparatus 100 may be installed for a temporary period and easily removed when not in use. This feature may make the apparatus 100 well suited for home use as the apparatus 100 would not take up valuable space in a home doorway while not in use. In one embodiment, the apparatus 100 may be lightweight making the apparatus 100 easy to transport, attach and remove. One apparatus 100 may weigh less than 15 pounds.

In other embodiments, the apparatus 100 may be mounted in locations other than a doorway. In another embodiment, the apparatus 100 may be wall mounted. The mount 160 or the mounting bars 162 may be attached directly to a wall or other surface for a more permanent installation. Additionally, the apparatus 100 may be attached to a height adjusting wall that allows for the height of the apparatus 100 to be modified. In this embodiment, the apparatus 100 may be mounted via bolts or other fasteners. Additionally, more than one apparatus 100 may be installed next to each other. This arrangement may allow two users to practice at one time, or a single user to practice with various targets at varying height or angles.

The design of the apparatus 100 of the present invention allows a user to strike the apparatus 100 in a variety of ways. The following martial arts techniques may be used with the apparatus 100 without having to modify the setup: straight punches, uppercuts, hooks, use as a speedbag, kicks, and elbows.

Figure 8:
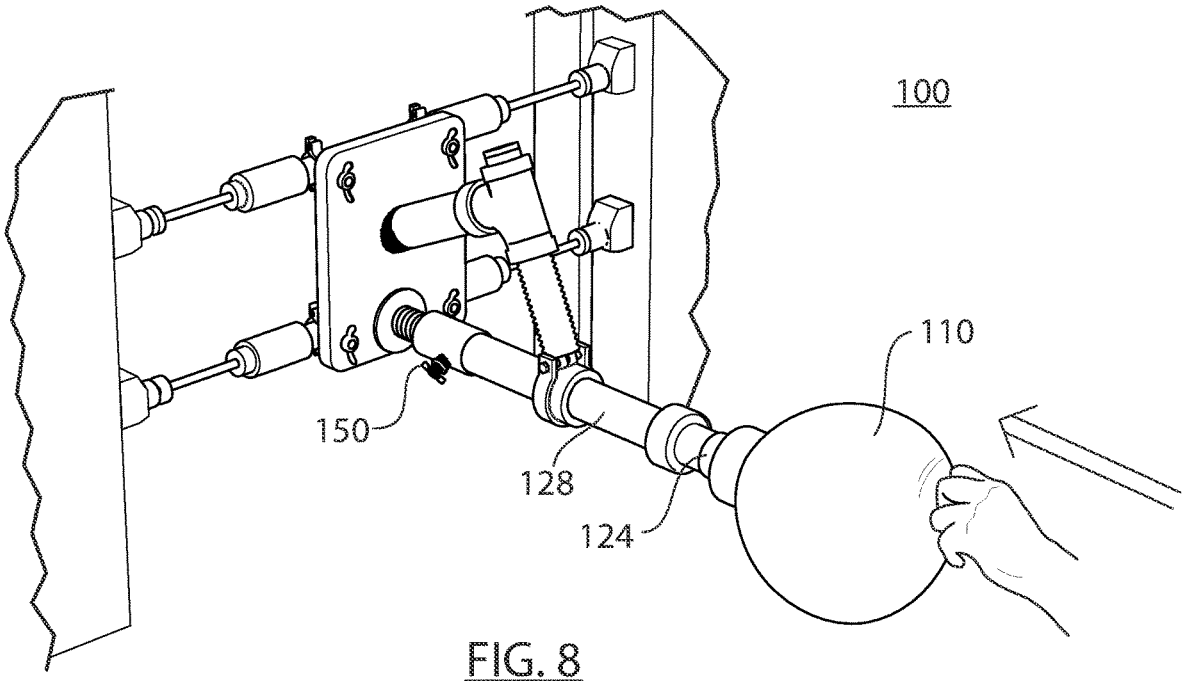
FIG. 8 illustrates an isometric view of the apparatus from FIG. 6 as the apparatus is struck by a straight punch.

As shown in FIG. 8, the apparatus 100 allows a user to strike the punching ball 110 with a straight punch. A straight punch is a strike on the punching ball 110 toward the mount 160 in approximately the same direction as the lengths of the extension rod 122 and the hollow arm 128. A user may be positioned in front of the punching ball 110 when practicing a straight punch. This setup may help a user maintain their center of gravity while punching at a 90-degree angle. As shown in FIG. 8, when the punching ball 110 is struck with a straight punch, the extension rod 122 is pushed further into the internal volume of the hollow arm 128, which may compress the internal spring 170. The internal spring 170 and the mount spring 126 may provide a dampening effect, absorbing some of the force caused by the straight punch. This absorbing effect may mitigate stress on the user when practicing straight punches, as well as mitigate vibrations and noise caused by the apparatus 100. Once the force of the strike is released, the internal spring 170 may then decompress to its predisposed position, pushing the extension rod 122 back out of the internal volume of the hollow arm 128. The extension rod 122 and the punching ball 110 are then returned to their initial position.

Furthermore, the resistance to the straight punch provided by the punching ball 110 may be adjusted with the air valve 150. The insertion of the extension rod 122 from the straight punch displaces the volume of air that was held by the internal volume of the hollow arm 128. If the displaced volume of air has no place to escape, air pressure within the hollow arm 128 will rise in response to the shrinking internal volume, which provides resistance on the punching ball 110. When the air valve 150 is open, the volume of air may easily escape through the open air valve 150. In this open scenario, the only resistance caused by air pressure is the result of the air passing through the open air valve 150. The smaller the opening of the air valve 150, the greater the restriction on the escaping air, and subsequently, the greater the resistance placed on the punching ball 110. Thus, turning the air valve 150 from an open position to a partially open position may reduce the size of the opening from which air may escape increasing the resistance of the punching ball 110.

The resistance of the punching ball 110 may be increased to its maximum when the air valve 150 is turned to the closed position. In this closed scenario, the displaced air may not escape through the air valve 150. The internal volume of the hollow arm 128 may be sealed in part due to an air-tight seal between the extension rod 122 and the hollow arm 128. The displaced air may have no place to escape. With no place to move the air within the internal volume of the hollow arm 128, the air pressure will increase significantly as the internal volume shrinks, providing a large amount of resistance for the punching ball 110. Thus, if the punching ball 110 is struck with an equal force, the extension rod 122 will travel further into the hollow arm 128 when the air valve 150 is open than when the air valve 150 is closed.

The ability to adjust the resistance of the punching ball 110 may allow a user to customize the resistance to suit the user's needs. For example, a professional boxer may adjust the apparatus 100 to a higher resistance than an amateur. Further, the apparatus 100 may be better suited to a wider range of users who may require less resistance, such as older adults or children.

The air valve 150 may also be utilized for other training workouts. An air gauge may be attached to the air valve 150 to measure a user's punching power. Additionally, a hose capable of inflating inflatable objects may be attached to the air valve 150. For example, the inflating hose may be used to inflate footballs, basketballs, other inflatable sports equipment, balloons, and other inflatable items. Inflating an object may be used as a workout technique. An uninflated object may be attached to a hose, which is attached to an air valve 150. Initially, the resistance of the punching ball 110 may be low as there is sufficient space in the deflated object to move the displaced air from the hollow arm 128. As the object becomes more inflated though, the space for the displaced air to escape may decrease, increasing the resistance of the punching ball 110. A user may strike the punching ball 110 repeatedly with increasing resistance until the object is inflated as a workout.

Another training workout that may be used with the apparatus 100 may include a hollow tube (not shown) containing one or more tube balls. The hollow tube may connect to the hollow arm 128 in such a way that the inner volume of the hollow tube is in fluid communication with the internal volume of the hollow arm 128. The hollow tube may be connected to the hollow arm 128 via a tube adapter. In one embodiment, the tube adapter may be L-shaped such that the hollow tube extends upwardly. In another embodiment, the tube adapter may contain a hole through the tube adapter. In yet another embodiment, the air valve 150 may be removed from the hollow arm 128 to install the tube adapter and connect to the hollow tube. The one or more tube balls may be light weight and/or hollow. The tube balls may also be installed within the inner volume of the hollow tube.

With the hollow tube attached, the one or more tube balls may sit at the bottom of the hollow tube. When the punching ball 110 is struck with a straight punch, a volume of air from the internal volume of the hollow arm 128 is pushed up the hollow tube. This force of air may push the tube balls up the hollow tube. When the punching ball 110 is struck repeatedly at a quick pace, the tube balls may be held at a height in the hollow tube above the bottom of the hollow tube. A possible training workout is to try to keep the tube balls at the top of the hollow tube for an interval of time by quickly and repeatedly striking the punching ball 110. The interval of time may be two minutes. This workout may train a user's cardio and speed.

Figure 6:
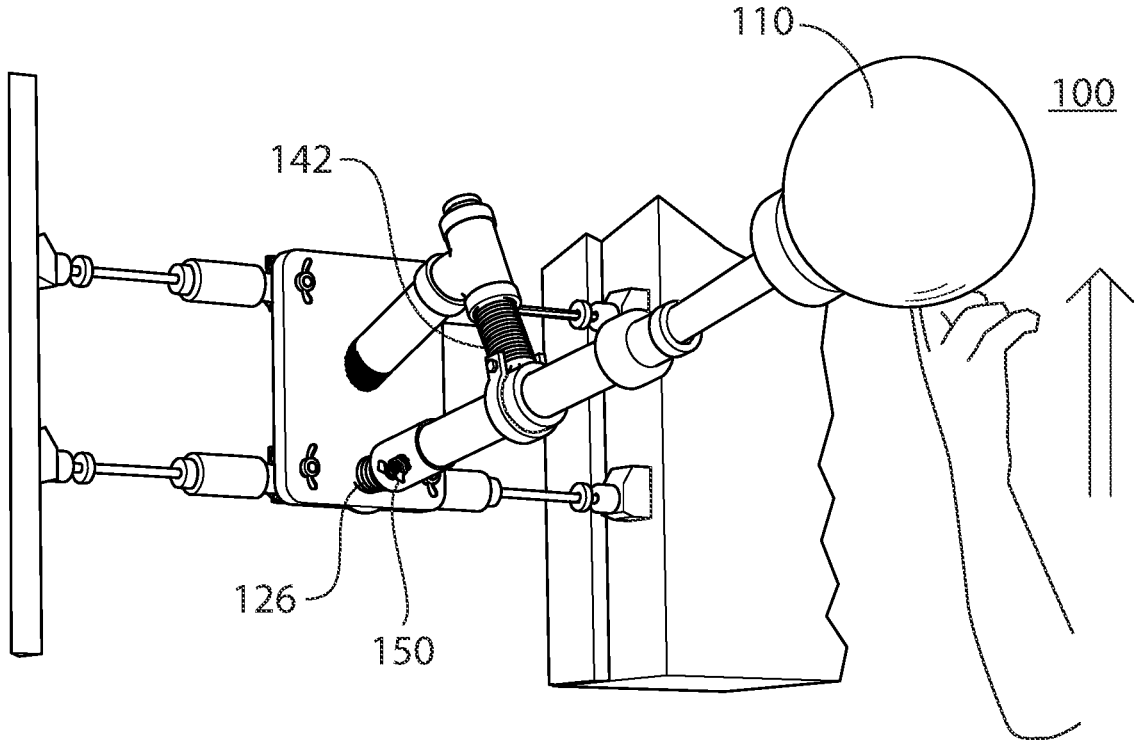
FIG. 6 illustrates an isometric view of an embodiment of a martial arts apparatus as the apparatus is struck by an uppercut.

As shown in FIG. 6, the apparatus 100 may be used to practice uppercuts. An uppercut may be a strike upwards on the punching ball 110 from the bottom of the punching ball 110 with either the left or right hand of the user. A user may be positioned in front of the punching ball 110 when practicing uppercuts. When struck with an uppercut, the one or more struts 140 and the mount spring 126 allow the punching ball 110 to move with the strike in the upward direction, as shown in FIG. 6. The struts 140 move in the linear, vertical direction and the distal end of the mount spring 126 bends upward, which allows the lower projection 120 to move upward. This movement of the punching ball 110 reduces the stress placed on the user. The struts 140 and the mount spring 126 then return to their predisposed position returning the lower projection 120 to its initial position.

Figure 7:
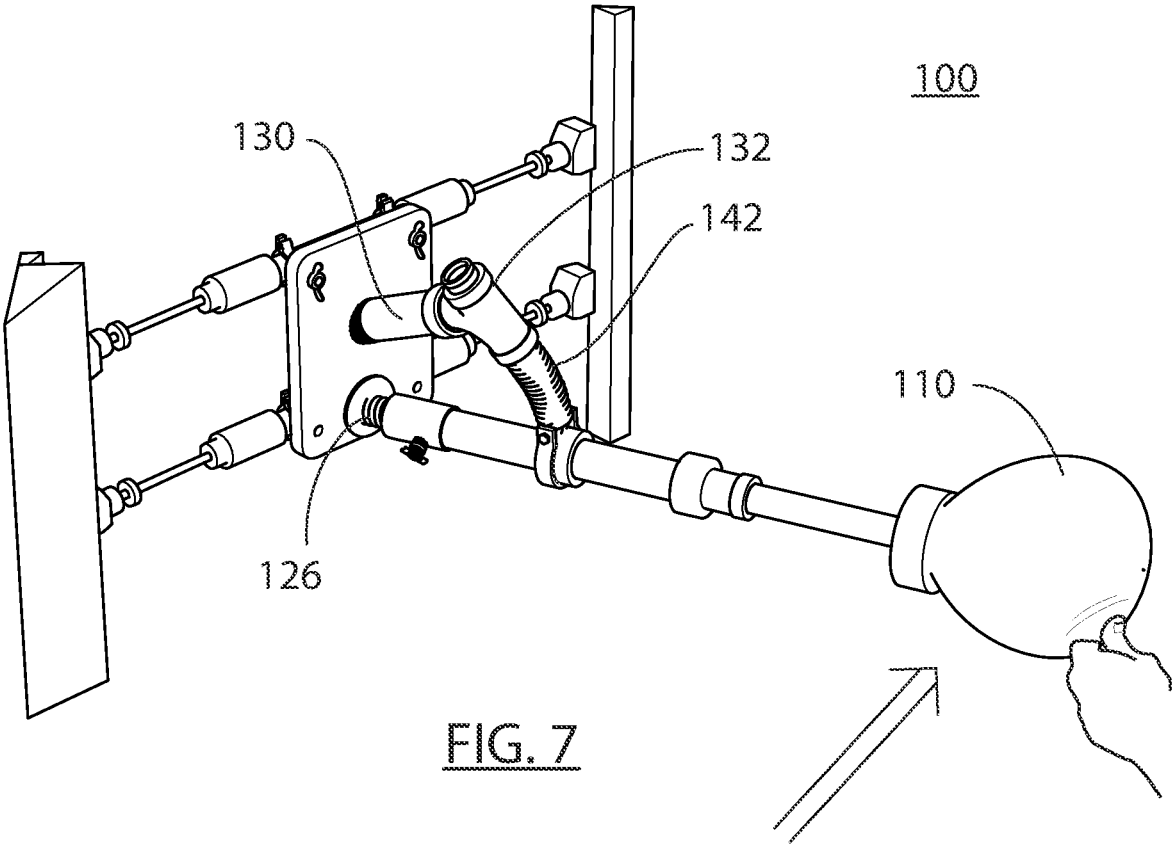
FIG. 7 illustrates an isometric view of the apparatus from FIG. 6 as the apparatus is struck by a hook.

As shown in FIG. 7, the apparatus 100 may also allow a user to practice left and right hooks. A left hook may be a punch from the left side with a user's left hand. A right hook may be a punch from the right side with a user's right hand. A user may be positioned in front of the punching ball 110 when practicing hooks. When struck with a hook, the mount spring 126 and the rotation of the upper arm 130 may allow the punching ball 110 to move to the left or right with the strike, as shown in FIG. 7. The distal end of the mount spring 126 may bend in the direction of the strike, and the upper arm 130 may rotate toward the direction of the strike. These movements may allow the lower projection 120 to move to either side with the strike. The subsequent moving of the punching ball 110 with the hook may reduce the stress placed on the user. The mount spring 126 then returns to its predisposed position returning the lower projection 120 to its initial position.

The apparatus 100 may also be used as a speed bag. Use as a speed bag incorporates a user striking the punching ball 110 with quick and repeated jabs. A user may stand to the side of the punching ball 110 when using the apparatus 100 as a speed bag. A user may quickly and repeatedly strike the punching ball 110 from the side. The mount spring 126 and the rotation of the upper arm 130 may allow the punching ball 110 to move with each strike. The mount spring 126 may then quickly return the punching ball 110 to its initial position after each strike, so that the punching ball 110 may be struck again. A mount spring 126 of a high strength quality may return the punching ball 110 back to its initial position more quickly, making the apparatus 100 more suitable for use as a speed bag.

Additional martial arts techniques may also be practiced with the apparatus 100. For example, the punching ball 110 may be able to be struck with an elbow or a kick. A user may practice straight or spinning elbows, as well as front and side kicks. A user may also practice head rolls when using the apparatus 100, as if the user was sparring. The present invention allows the punching ball 110 to move with a strike in a variety of directions. In one embodiment, the punching ball 110 may be able to move up to 45 degrees in the side-to-side and up-and-down directions. This makes the apparatus 100 suitable for practicing a wide range of martial arts techniques without needing to modify the apparatus 100.

The apparatus 100 may also be used with certain training programs, such as an 18-step teaching program named Precision Boxing Program, which inspired development of the device. The apparatus 100 and Precision Boxing Program may be used by two users training one-on-one.

Figure 9:
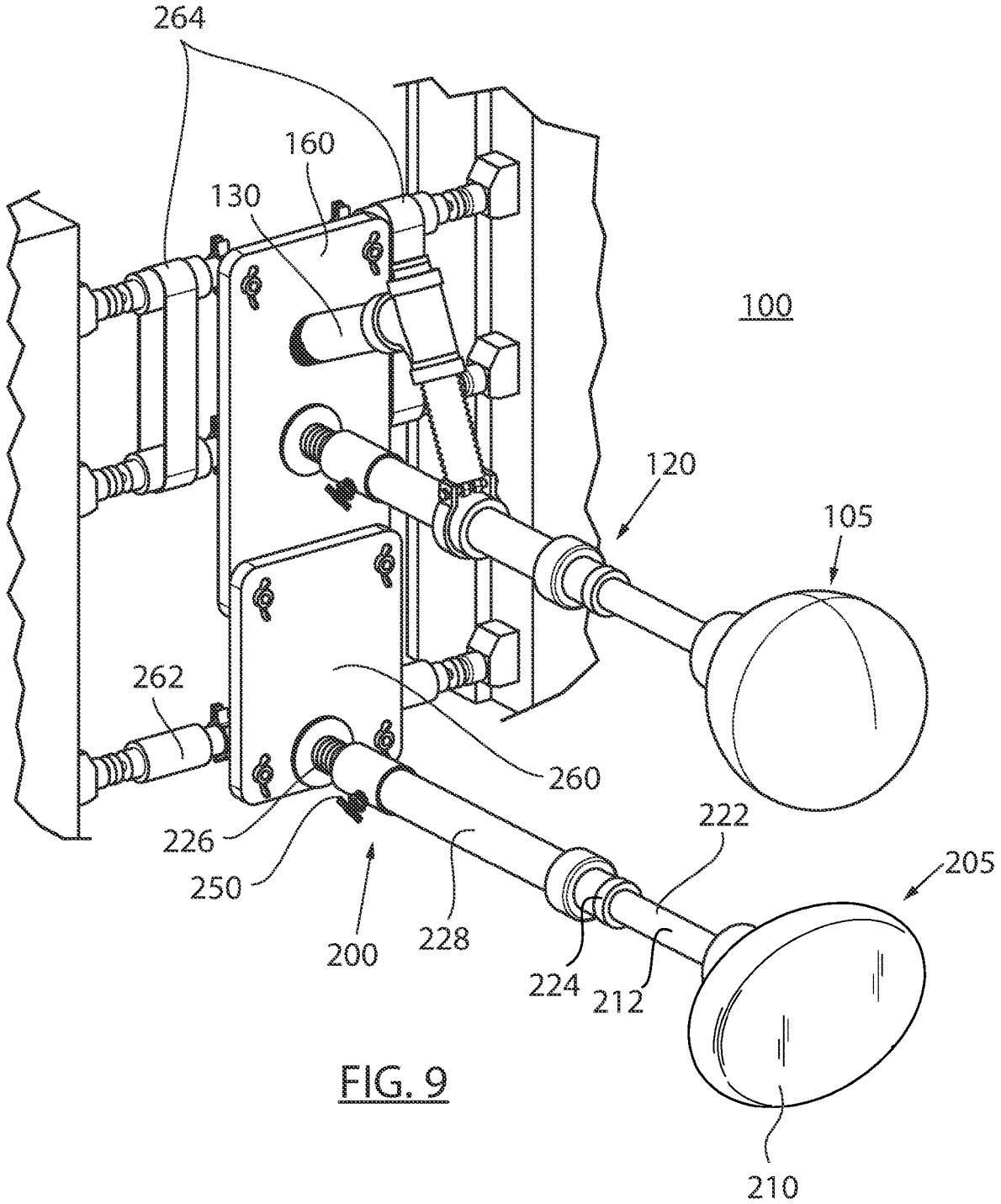
FIG. 9 illustrates an isometric view of another embodiment of a martial arts apparatus in accordance with the present invention having a lower attachment with a kick pad assembly.

As shown in FIG. 9, another embodiment of the present invention may include a lower attachment 200 that includes a kick pad assembly 205. The lower attachment 200 provides a similar configuration as the lower projection 120, except the punching ball assembly 105 is replaced with a kick pad assembly 205.

The lower attachment 200 may include a secondary mount 260 that connects to the mount 160 and/or mounting bars 162 of the apparatus 100. In one embodiment, the secondary mount 260 is attached to the bottom portion of the mount 160 via fasteners, such as wing nut bolts. The lower attachment 200 may also include one or more attachment bars 262 connected to the secondary mount 260 to stabilize the lower attachment 200 in a doorway. The attachment bar 262 may be identical to the mounting bar(s) 162 used with mount 160. In one embodiment, the attachment bar 262 is an adjustable pull-up bar and is attached to the secondary mount 260 via a bar clamp.

A hollow arm 228 extends, directly or indirectly, from the secondary mount 260. The hollow arm 228 may be identical to the hollow arm 128 in the lower projection 120. The hollow arm 228 defines an internal volume within the hollow arm 228 that contains some volume of air. Further, the hollow arm 228 has two ends, the near or proximate end connected, directly or indirectly, to the secondary mount 260.

In one embodiment, the proximate end of the hollow arm 228 of the lower attachment 200 is directly connected to the secondary mount 160. In another embodiment, the proximate end of the hollow arm 228 is connected to a mount spring 226. The mount spring 226 of the lower attachment 200 may be identical to the mount spring 126 of the lower projection 120. The distal end of the mount spring 226 may be connected, directly or indirectly, to the hollow arm 228, and the proximate end of the mount spring 226 may be connected, directly or indirectly, to the secondary mount 260. The lower arm attaches by a 1½" threaded end that screws directly into the lower attachment support board.

In the lower attachment 200, the distal end of the hollow arm 228 is connected to an extension rod 222. The extension rod 222 in the lower attachment 200 may be identical to the extension rod 122 in the lower projection 120. The extension rod 222 is elongated having two ends, the near or proximate end connected to the distal end of the hollow arm 228.

The extension rod 222 and the hollow arm 228 may be connected in such a way that at least part of the extension rod 222 is inserted into the internal volume of the hollow arm 228. The extension rod 222 may be capable of sliding further into and out of the internal volume of the hollow arm 228. This connection may be formed with a special connector 224, which may be identical to the special connector 124 in the lower projection 120. The connection between the extension rod 222 and the hollow arm 228 may form an air-tight seal such that the air within the internal volume of the hollow arm 228 may not escape the internal volume through the connection under normal conditions. In one embodiment, an air-tight seal may be formed by having the extension rod 222 inserted through the special connector 224 with minimal clearance between the extension rod 222 and the special connector 224.

An internal spring 270 may also be included within the hollow arm 228. The internal spring 270 in the lower attachment 200 may be identical to the internal spring 170 in the lower projection 120. The internal spring 270 may abut or be connected to extension rod 222 to provide resistance to and dampen the force of the extension rod 222 being further inserted into the internal volume of the hollow arm 228. The internal spring 270 is also predisposed to return the extension rod 222 to its initial position after being inserted into the internal volume of the hollow arm 228.

A striking surface is attached to the distal end of the extension rod 222. In one embodiment, a punching ball assembly 105 is attached to the extension rod 222. In another embodiment, a kick pad assembly 205 is attached to the distal end of the extension rod 222, as shown in FIG. 9. A kick pad assembly 205 may include a kick pad 210 and a kick pad support 212. The kick pad 210 may provide a cushioned surface for the user to strike. In one embodiment, the kick pad 210 provides a flat surface for striking. The kick pad support 212 covers the connection between the extension rod 222 and the kick pad 210.

The lower attachment 200 may also include an air valve 250 in fluid connection with the internal volume of the hollow arm 228. The air valve 250 on the lower attachment 200 may be identical to the air valve 150 on the lower projection 120. The air valve 250 may include an open position, a closed position, and a partially open/closed position. Similar to the lower projection 120, opening and closing the air valve 250 varies the air pressure within the internal volume of the hollow arm 228, which subsequently varies the resistance of the kick pad 210 when struck with a straight strike (i.e., a strike, kick, or punch in the same direction as the length of the hollow arm 228). Another embodiment of the apparatus lower attachment 200 may have a 35 pound hydraulic strut within the hollow arm.

Figure 10:
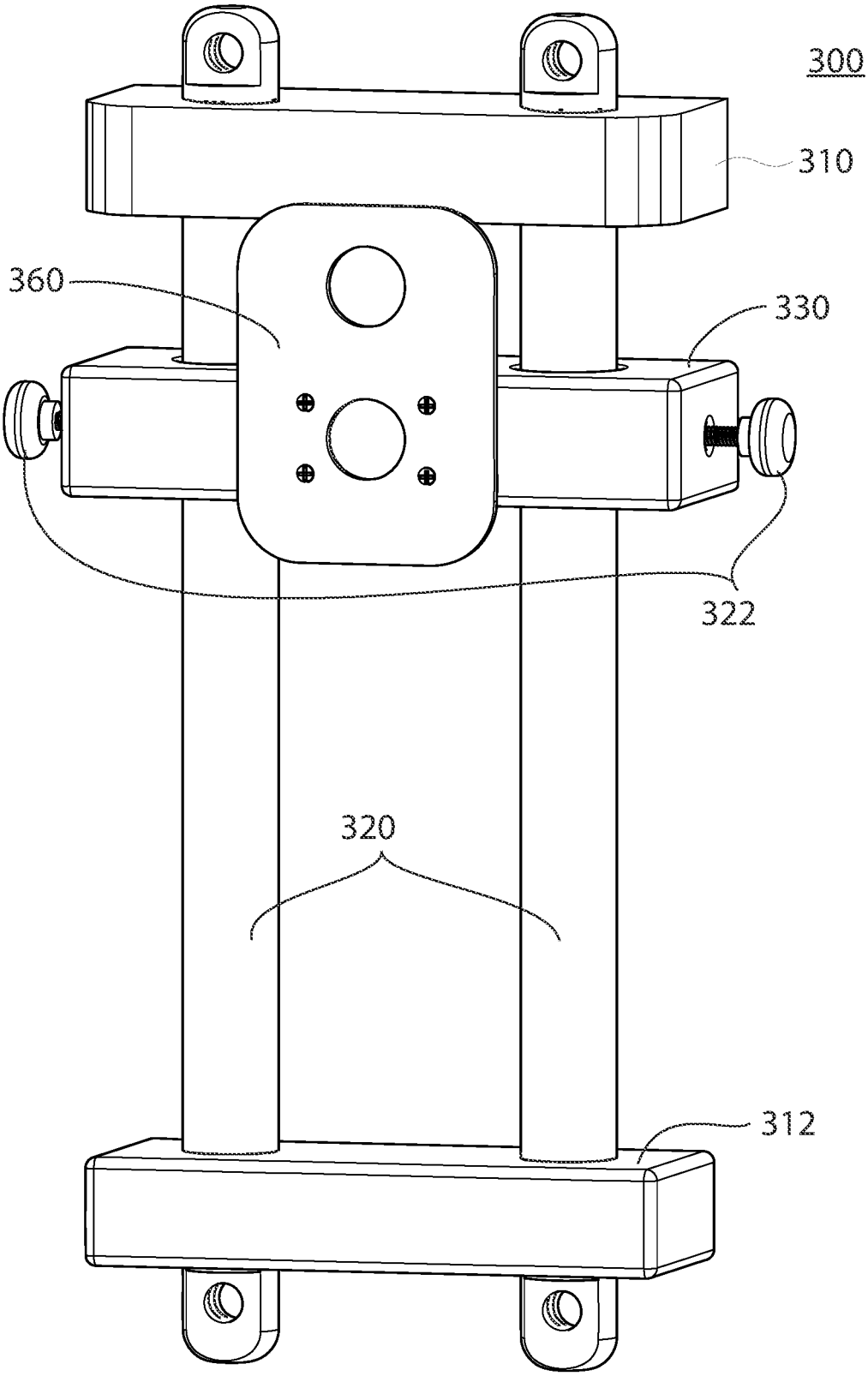
FIG. 10 illustrates an isometric view of a wall mount assembly of another embodiment of a martial arts apparatus in accordance with the present invention.

Another embodiment of the apparatus 100 includes a wall mount assembly 300, as shown in FIG. 10. The wall mount assembly 300 includes one or poles 320. A pole 320 may be elongated with a bolt hole on either end of the pole 320, through which the poles 320 are mounted to a wall or other secure surface. In one embodiment, the wall mount assembly 300 includes two poles 320 mounted vertically on a wall, as shown in FIG. 10.

The wall mount assembly 300 may also include a height adjuster 330. The height adjuster 330 includes bore holes corresponding to each pole 320 in the wall mount assembly 300. Each pole 320 is installed through the respective bore holes of the height adjuster 330 such that the height adjuster 330 can slide along the length of the poles 320. At least one height adjustment screw 322 may be inserted through the height adjuster 330 so that the height adjustment screw 322 can contact a pole 320. When the height adjustment screw 322 is tightened and contacts a pole 320, the height adjuster 330 is locked in place. When the height adjustment screw 322 is loosened and is not contacting a pole 320, the height adjuster 330 is free to slide along the poles 320, subsequently allowing the user to change the height of the apparatus 100.

A support mount 360 is connected to the height adjuster 330 allowing the height of the support mount 360 to change with the height adjuster 330. In one embodiment, the mount 160 and/or the secondary mount 260 are attached to the support mount 360. In another embodiment, the support mount 360 includes one or more bore holes. The lower projection 120 and/or the upper arm 130 may be attached to the support mount 360 through the bore holes. The lower projection 120 and/or upper arm 130 may extend from the support mount 360.

The wall mount assembly 300 may also include a top stopper 310 and a bottom stopper 312, mounted near the top and bottom of the poles 320, respectively. The height adjuster 330 is located between the top stopper 310 and the bottom stopper 312. The top stopper 310 and bottom stopper 312 are fixed in one location on the poles 320, effectively preventing the height adjuster 330 from moving past either stopper 310, 312. The top stopper 310 and bottom stopper 312 effectively set the maximum and minimum height for the apparatus 100 on the wall mount assembly 300.

Another embodiment for a doorway mounted apparatus 100 may utilize one or more Velcro straps 264 around a pair of mounting bars 164 to install the apparatus 100. When the top mounting bar 164 is locked in place, for example in a doorway, the lower mounting bar 164 is lowered until the Velcro straps 264 are taught. Once taught, the lower mounting bar 164 is locked in place. The Velcro straps 264 allow the mounting bars 164 to be consistently installed at the same heights.

Although the best modes contemplated by the inventor of carrying out the present invention are disclosed above, practice of the present invention is not limited thereto. It will be manifest that various additions, modifications and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the appended claims and other attachments. It is also understood that the invention disclosed and defined herein extends to all alternative combinations of two or more of the individual features mentioned or evident from the text and/or drawings. All of these different combinations constitute various alternative aspects of the present invention.

I claim:

1. A martial arts apparatus comprising: a mount; a projection extending from the mount, the projection having a spring extending from the mount, a hollow arm extending from the spring, the hollow arm defining an internal volume, an air valve in fluid communication with the internal volume of the hollow arm, the air valve having an open position and a closed position, wherein the internal volume of the hollow arm is at least partially sealed in the closed position, an extension rod extending from the hollow arm, wherein the extension rod is at least partially inserted into the internal volume of the hollow arm, and a punching ball extending from the extension rod.

2. The martial arts apparatus of claim 1, wherein the internal volume of the hollow arm is unsealed with the air valve in the open position.

3. The martial arts apparatus of claim 2, wherein the internal volume of the hollow arm is substantially sealed with the air valve in the closed position.

4. The martial arts apparatus of claim 3, wherein the air valve has an intermediate position wherein the internal volume of the hollow arm is partially sealed.

5. The martial arts apparatus of claim 1, further comprising: a second arm extending from the mount; a linkage connecting the hollow arm and the second arm, the linkage moveable in at least one direction.

6. The martial arts apparatus of claim 5, wherein the linkage includes at least one strut.

7. The martial arts apparatus of claim 5, wherein the second arm is rotatable around a center axis of the second arm.

8. The martial arts apparatus of claim 1, further comprising: an internal spring inside the internal volume of the hollow arm, the internal spring predisposed to push the extension rod outwardly from the internal volume of the hollow arm.

9. The martial arts apparatus of claim 1, further comprising: a connection between the hollow arm and the extension rod forming an air-tight seal.

10. The martial arts apparatus of claim 1, further comprising: at least one mounting bar attached to the mount.

11. A method of practicing martial arts comprising: providing a martial arts apparatus having a mount, a spring extending from the mount, a hollow arm extending from the spring, the hollow arm having a length and defining an internal volume holding a volume of air, an air valve in fluid communication with the internal volume of the hollow arm, the air valve having an open position and a closed position, an extension rod extending from the hollow arm, wherein the extension rod is at least partially inserted into the internal volume of the hollow arm, and a punching ball; striking the punching ball in a direction along a longitudinal axis defined by the hollow arm with the air valve in the open position so as to insert the extension rod further into the hollow arm, displacing the extension rod from an initial position; expelling at least part of the volume of air out of the internal volume of the hollow arm through the air valve in the open position; and returning the extension rod to the initial position.

12. The method of claim 11, further comprising: providing the martial arts apparatus having a second arm extending from the mount, and a linkage connecting the hollow arm and the second arm, the linkage located at an initial linkage position; striking the punching ball in at least one direction; moving at least part of the linkage in the same direction as the strike, displacing at least part of the linkage from the initial linkage position; and returning the linkage to the initial linkage position.

13. The method of claim 12, wherein the punching ball is struck in one of an upward direction or a sideways direction.

14. The method of claim 11, further comprising: performing two or more martial arts techniques without modifying the martial arts apparatus, the martial arts techniques selected from a group consisting of a straight punch, a hook, an uppercut, a speedbag strike, a kick, and an elbow.

15. The method of claim 11, further comprising: adjusting the air valve to the closed position; striking the punching ball in a direction along a longitudinal axis defined by the hollow arm with the air valve in the closed position so as to insert the extension rod further into the hollow arm with the air valve in the closed position, displacing the extension rod from the initial position; maintaining a majority of the volume of air within the internal volume of the hollow arm; returning the extension rod to the initial position with the air valve in the closed position.

16. A martial arts apparatus comprising:

a mount;

a projection extending outwardly from the mount, the projection defining a distal end to which a punching member is connected;

wherein the projection is interconnected with the mount via a support arrangement that enables movement of the projection in a side-to-side direction relative to the mount, wherein the support arrangement includes a biasing arrangement that moves the projection and the punching member to a rest position subsequent to the punching member being subjected to a sideways force by a user; and wherein the punching member is interconnected with the projection via a punching member mounting arrangement that enables movement of the punching member in an inward-outward direction relative to the mount, wherein the punching member mounting arrangement includes a biasing arrangement that moves the punching member outwardly to the rest position subsequent to the punching member being subjects to an inward force by the user.

17. The martial arts apparatus of claim 16, wherein the support arrangement comprises an arm extending outwardly from the mount at a location spaced from the projection, and a strut interconnecting the arm and the projection, wherein the biasing arrangement of the support arrangement comprises a spring that connects an inner end defined by the projection to the mount.

18. The martial arts apparatus of claim 16, wherein the projection defines an internal passage extending along a longitudinal axis, and wherein the punching member mounting arrangement comprises an extension member to which the punching member is mounted, wherein the extension member is positioned within the internal passage and movable inwardly and outwardly within the internal passage, and wherein the biasing arrangement of the punching member mounting arrangement comprises a spring positioned within the internal passage of the projection that urges the extension member outwardly so as to position the punching member in the rest position.

19. A martial arts apparatus comprising: a mount; an arm extending from the mount; a projection extending from the mount, the projection having a punching ball connected to a distal end of the projection; a linkage connecting the arm and the projection, the linkage moveable in at least one direction, and wherein the arm is rotatable around a center axis defined by the arm.

20. The martial arts apparatus of claim 19, further comprising: a threaded connection between the arm and the mount, wherein the threaded connection includes sufficient clearance between the arm and the mount to make the arm rotatable around the center axis of the arm.

21. A martial arts apparatus comprising: a mount; an arm extending from the mount; a projection extending from the mount, the projection having a punching ball connected to a distal end of the projection; a linkage connecting the arm and the projection, the linkage moveable in at least one direction, and wherein the linkage includes at least one strut.

* * * * *